US005173201A

United States Patent [19]

Coffindaffer et al.

[11] Patent Number: 5,173,201

[45] Date of Patent: Dec. 22, 1992

[54] MICROEMULSIFIED AMINE FUNCTIONAL SILICONE IN LIQUID FABRIC SOFTENERS FOR REDUCING FIBER-FIBER AND YARN-YARN FRICTION IN FABRICS

[75] Inventors: Timothy W. Coffindaffer, Loveland, Ohio; Sheila G. Buzzee, Fort Mitchell, Ky.

[73] Assignee: The Proctor & Gamble Company, Cincinnati, Ohio

[21] Appl. No.: 771,892

[22] Filed: Oct. 7, 1991

Related U.S. Application Data

[63] Continuation of Ser. No. 557,438, Jul. 23, 1990, abandoned.

[51] Int. Cl.[5] ..... D06M 10/08

[52] U.S. Cl. ..... 252/8.8; 252/8.6; 252/8.7; 252/8.75; 252/8.9; 252/174.15

[58] Field of Search ..... 252/8.6, 8.7, 8.75, 252/8.8, 8.9, 174.15

[56] References Cited

U.S. PATENT DOCUMENTS

| | | | |
|---|---|---|---|
| 4,052,331 | 10/1977 | Dumoulin | 252/312 |
| 4,525,281 | 6/1985 | Cooper | 210/735 |
| 4,559,227 | 12/1985 | Chandra et al. | 424/70 |
| 4,620,878 | 11/1986 | Gee | 106/287.15 |
| 4,733,677 | 3/1988 | Gee et al. | 132/7 |
| 4,806,255 | 2/1989 | König et al. | 252/8.8 |

FOREIGN PATENT DOCUMENTS

| | | |
|---|---|---|
| 0228575 | 11/1986 | European Pat. Off. . |
| 1549180 | 7/1979 | United Kingdom . |
| 2215729A | 12/1988 | United Kingdom . |

*Primary Examiner*—Paul Lieberman
*Assistant Examiner*—William S. Parks
*Attorney, Agent, or Firm*—Robert B. Aylor

[57] ABSTRACT

This invention relates to liquid fabric care compositions comprising a microemulsified amine functional silicone for reducing fiber-fiber/yarn-yarn friction and a fabric softener. The microemulsified amine functional silicone is more effective than prior art amine functional silicone macroemulsions when used with a fabric softener. Preferred composiitons are aqueous based fabric care and are used in the rinse cycle of a fabric care operation.

19 Claims, No Drawings

MICROEMULSIFIED AMINE FUNCTIONAL SILICONE IN LIQUID FABRIC SOFTENERS FOR REDUCING FIBER-FIBER AND YARN-YARN FRICTION IN FABRICS

This is a continuation of application Ser. No. 07/557,438, filed on Jul. 23, 1990 now abandoned.

FIELD OF THE INVENTION

This invention relates to fabric care compositions and to a method for treating fabrics in order to improve various properties of the fabric, in particular, reduction of fiber-fiber and yarn-yarn friction.

BACKGROUND OF THE INVENTION

The use of silicones for softening fabrics, i.e., providing lubrication between fibers and yarns so they move over one another more easily, has been well known for quite some time. In addition, the use of organomodified silicones for textile treatments has also been well documented over the years (See U.S. Pat. Nos. 4,620,878, Gee, issued Nov. 4, 1986; 4,705,704, Lane et al., issued Nov. 10, 1987; 4,800,026, Coffindaffer et al., issued Jan. 24, 1989; 4,824,877, Glover et al., issued Apr. 25, 1989; and 4,824,890, Glover et al., issued Apr. 25, 1989; also of interest is Brit. Pat. Appln. 87-29,489, Walbeoff, published Dec. 18, 1987, all of said patents and said application being incorporated herein by reference). Silicones of this type are typically delivered to textiles in the form of an aqueous emulsion. More recently, much work has concentrated on the aqueous delivery of these systems via microemulsions. The above art suggests that microemulsions have two advantages over conventional "macro" emulsions: (1) they are more stable and (2) they require less mechanical energy to make.

While hand evaluation of fabrics to determine softness is still practiced widely, about 20 years ago Dr. Sueo Kawabata et al. began evaluating textiles via a mechanical approach. They designed instruments to measure low deformation forces, typical of hand analysis, on fabrics. Although these instruments (commonly known as the Kawabata Evaluation System or KES) were designed to be quality control tools for fabric acceptance, the instruments have also been used to study the effect of fabric treatments. Two such studies have been published by Union Carbide Co.: Sabia, A. J. and Pagluighi, A. M. *Textile Chemist and Colorist*, Vol. 19, No. 3, March 1987, p. 5; and Barndt, H. J., Sabia, A. J. and Pagluighi, A. M., *Textile Chemist and Colorist*, Vol. 21, No. 12, December 1989, p. 16. The shearing instrument, in particular the shearing hysteresis measurement, is believed to be indicative of the ease with which fibers and/or yarns move over one another. Thus, the lower the shear hysteresis value, the better the lubricant.

The term "reduced fiber-fiber/yarn-yarn friction" (reduced friction between individual fibers within the yarn as well as between the yarn strands) as used herein means that the fabric exhibits a lower shear hysteresis value as measured by the KES shearing instrument. While not wishing to be bound by theory, it is believed that a reduction in reduced fiber-fiber/yarn-yarn friction provides better drape, hand, and wrinkle removal during tumble drying and ironing processes due to the fibers being more easily moved over one another.

SUMMARY OF THE INVENTION

This invention relates to fabric care compositions comprising a microemulsified amine functional silicone agent and a fabric softener for use in a fabric care operation whereby an effective amount of said microemulsified amine functional silicone is deposited on said fabric for reduced fiber-fiber/yarn-yarn friction.

DETAILED DESCRIPTION OF THE INVENTION

This invention relates to microemulsified amine functional silicone compositions for reduced fiber-fiber-/yarn-yarn friction. In another respect this invention relates to methods of using such microemulsified amine functional silicone compositions in the care of fabrics for reduced fiber-fiber/yarn-yarn friction. Preferred compositions are aqueous fabric softeners. Such compositions are usually added to either the wash or rinse water of a laundering operation. These preferred compositions are aqueous based, water-dispersible compositions which contain from about 0.05% to about 25%, more preferably from about 0.1% to about 15% of the microemulsified amine functional silicones. The compositions are diluted in the wash or rinse.

Surprisingly, the Microemulsified Amine Functional Silicones (MAFS) incorporated into a liquid fabric softener composition exhibit a synergistic behavior when compared to the corresponding "macro" emulsified material. Said differently, used by itself, the MAFS performance for reduced fiber-fiber/yarn-yarn friction is not as good as that of the macroemulsified system; however, in the context of a liquid fabric softener composition the MAFS composition provides a greater reduction in shear hysteresis values than the corresponding macroemulsion in an analogous liquid fabric softener composition.

A preferred embodiment comprises: a liquid rinse water composition comprising the microemulsified amine functional silicone plus fabric softener, preferably quaternary ammonium fabric softener.

In a preferred execution, about 0.1% to about 10% by weight of microemulsified amine functional silicone is mixed into any suitable prior art laundry liquid fabric softener composition. The result is a fabric care composition that provides a reduced fiber-fiber/yarn-yarn friction benefit to the treated fabric.

Silicone Microemulsions

Over the last 5 years, there have been many patents published in the area of silicone microemulsions (U.S. Pat. Nos. 4,620,878; 4,705,704; 4,824,877; 4,824,890, all supra; also of interest is Brit. Pat. 87-29,489, supra; all of said patents and said application being incorporated herein by reference). In this literature, silicone microemulsions have been described as translucent silicone emulsions with average particle sizes smaller than 0.14 microns. In this art, microemulsions are taught as having two advantages over conventional "macro" emulsions: (1) they are more stable and (2) they require less mechanical energy to make. There is no disclosure either that microemulsions can reduce fiber to fiber and-/or yarn to yarn friction as compared to macroemulsions when used with a fabric softener. Since microemulsions are inferior in performance to macroemulsions when used alone, any investigation which starts logically with the individual dispersions would discourage further investigation.

The amine functional silicones herein preferably have an average molecular weight of from about 1,000 to about 100,000, preferably from about 1,000 to 50,000more preferably from about 1,500 to about 20,000, and can be prepared by emulsion polymerization of low molecular weight polymers and/or monomers, more preferably low molecular weight polymers. Emulsion polymerization can provide a high concentration of microemulsified silicone.

Some Preferred Embodiments

The preferred composition of this invention is an aqueous dispersion comprising: a microemulsified amine functional silicone wherein the weight ration of microemulsified amine functional silicone to fabric softener is from about 17:1 to about 1:350, preferably from about 10:1 to about 1:100. Even more preferred weight ratios of microemulsified amine functional silicone to fabric softener are from about 1:1 to about 1:10, and more preferably, from about 1:5 to about 1:10. These compositions are added to the rinse water for reduced fiber-fiber/yarn-yarn friction and fabric softening benefits.

Suitable fabric softener(s) are selected from the group consisting of:

i. quaternary ammonium compound;
ii. fatty amine compound;
iii. fatty amide compound;
iv. fatty acids;
v. fatty alcohols; and
vi. mixtures thereof.

In certain liquid rinse-added compositions of this invention the amount of fabric softener can range from about 2% to about 35%, preferably from about 4% to about 27%, by weight of the total composition. The lower limits are needed to contribute effective fabric softening performance when added to laundry rinse baths in the manner which is customary in home laundry practice. The higher limits are suitable for more concentrated liquid products which require either smaller volume usage or dilution prior to use.

The preferred levels of microemulsified amine functional silicone in such composition can range from about 0.05% to about 40%; preferably from about 0.1% to about 20%; and more preferably from about 0.5% to about 10% by weight of the concentrate.

Suitable fabric softener compounds include quaternary ammonium salts, as well as nonquaternary amines and amine salts.

Compositions containing cationic nitrogenous compounds in the form of quaternary ammonium salts and substituted imidazolinium salts having two long chain acyclic aliphatic hydrocarbon groups provide fabric softening benefits when used in laundry rinse operations. (See, for example, U.S. Pat. Nos. 3,644,203, Lamberti et al., issued Feb. 22, 1972; and 4,426,299, Verbruggen, issued Jan. 17, 1984; also "Cationic Surface Active Agents as Fabric Softeners," R. R. Egan, Journal of the American Oil Chemists' Society, January 1978, pages 118–121; and "How to Choose Cationics for Fabric Softeners," J. A. Ackerman, Journal of the American Oil Chemists' Society, June 1983, pp. 1166–1169).

Other suitable fabric softening compounds are the nonquaternary amides and the nonquaternary amines. A commonly cited material is the reaction product of higher fatty acids with hydroxy alkyl alkylene diamines. An example of these materials is the reaction product of higher fatty acids and hydroxyethylethylenediamine (See "Condensation Products from beta-hydroxyethylethylenediamine and Fatty Acids or Their Alkyl Esters and Their Application as Textile Softeners in Washing Agents," H. W. Eckert, Fette-Seifen-Anstrichmittel, September 1972, pages 527–533). These materials are usually cited generally along with other cationic quaternary ammonium salts and imidazolinium salts as softening actives in fabric softening compositions. (See U.S. Pat. Nos. 4,460,485, Rapisarda et al., issued Jul. 17, 1984; 4,421,792, Rudy et al., issued Dec. 20,1983; 4,327,133, Rudy et al., issued Apr. 27, 1982).

A particularly preferred fabric softener is in the form of an aqueous dispersion comprising from about 3% to about 35% by weight of a mixture consisting of:

(a) from about 10% to about 92% of the reaction product of a higher fatty acid with a polyamine selected from the group consisting of hydroxyalkylalkylenediamines and dialkylenetriamines and mixtures thereof, and
(b) from about 8% to about 90% of cationic nitrogenous salts having only one long chain acyclic aliphatic $C_{15}$–$C_{22}$ hydrocarbon group, and optionally,
(c) from 0% to about 80% of a cationic nitrogenous salt having two or more long chain acyclic aliphatic $C_{15}$–$C_{22}$ hydrocarbon groups or one said group and an arylalkyl group having from about 15 to about 22 carbon atoms in its alkyl chain.

For a detailed description of some preferred fabric softeners, see commonly assigned U.S. Pat. No. 4,661,269, Trinh/Wahl/Swartley/Hemingway, issued Apr. 28, 1987, incorporated herein by reference in its entirety.

The terms herein, e.g., softener compound, in general, denotes both singular and plural unless otherwise specified.

Preferred carriers are liquids selected from the group consisting of water and mixtures of water and short chain $C_1$–$C_4$ monohydric alcohols. The water which is used can be distilled, deionized, and/or tap water. Mixtures of water and up to about 10%, preferably less than about 5%, of short chain alcohol such as ethanol, propanol, isopropanol or butanol, and mixtures thereof, are also useful as the carrier liquid. Carriers which are primarily water are desirable.

Some short chain alcohols are present in commercially available quaternary ammonium compound products. Such products can be used in the preparation of preferred aqueous compositions of the present invention. The short chain alcohols are normally present in such products at a level of from about 0.5% to about 10% by weight of the aqueous compositions.

Some Optional Ingredients and Preferred Embodiments

Compatible adjuvants can be added to the compositions herein for their known purposes. Such adjuvants include, but are not limited to, viscosity control agents, perfumes, emulsifiers, preservatives, antioxidants, bactericides, fungicides, colorants, dyes, fluorescent dyes, brighteners, opacifiers, freeze-thaw control agents, soil release agents, and shrinkage control agents, and other agents to provide ease of ironing (e.g., starches, etc.). These adjuvants, if used, are added at their usual levels, generally each of up to about 5% by weight of the preferred liquid composition.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the liquid compositions herein, and later to obtain the desired viscosity. The amount of ionizable salts used depends on the amount of active ingredients used in such compositions and can be adjusted according to the desires of the formulator. Typical levels of salts used to control the composition viscosity are from about 20 to about 6,000 parts per million (ppm), preferably from about 20 to about 4,000 ppm by weight of the composition.

Soil release agents, usually polymers, are desirable additives at levels of from about 0.1% to about 5%. Suitable soil release agents are disclosed in U.S. Pat. Nos. 4,702,857, Gosselink, issued Oct. 27, 1987; 4,711,730, Gosselink and Diehl, issued Dec. 8, 1987; 4,713,194, Gosselink issued Dec. 15, 1987; and mixtures thereof, said patents being incorporated herein by reference. Other soil release polymers are disclosed in U.S. Pat. Nos. 4,749,596, Evans, Huntington, Stewart, Wolf, and Zimmerer, issued Jun. 7, 1988; 3,928,213, Temple, Heuring, and Prentice, issued Dec. 23, 1975; 4,136,038, Pracht and Burns, issued Jan. 23, 1979; and 4,661,267, Dekker, Konig, Straathof, and Gosselink, issued Apr. 28, 1987, said patents being incorporated herein by reference.

Typical levels of compatible bactericides used in the present compositions are from about 1 to about 1,500 ppm by weight of the composition.

Examples of antioxidants that can be added to the compositions of this invention are propyl gallate, available from Eastman Chemical Products, Inc., under the trade names Tenox ® PG and Tenox S-1, and butylated hydroxy toluene, available from UOP Process Division under the trade name Sustane ® BHT.

The compositions can contain other silicone fluids to provide additional benefits such as improved fabric feel. The preferred adjunct silicones are polydimethylsiloxanes of viscosity of from about 100 centistokes (cs) to about 100,000 cs, preferably from about 200 cs to about 60,000 cs. These adjunct silicones can be used as is, or can be conveniently added to the softener compositions in a preemulsified form which is obtainable directly from suppliers. Examples of these preemulsified silicones are 60% emulsion of polydimethylsiloxane (350 cs) sold by Dow Corning Corporation under the trade name DOW CORNING ® 1157 Fluid and 50% emulsion of polydimethylsiloxane (10,000 cs) sold by General Electric Company under the trade name General Electric ® SM 2140 Silicones. The optional silicone component can be used in an amount of from about 0.1% to about 6% by weight of the composition.

A preferred composition contains from about 1 ppm to about 1,000 ppm of bactericide, from about 0.2% to about 2% of perfume, from 0% to about 3% of polydimethylsiloxane, from 0% to about 0.4% of calcium chloride, from about 10 ppm to about 100 ppm of dye, and from 0% to about 10% of short chain alcohols, by weight of the total composition.

The pH of the preferred compositions of this invention is generally adjusted to be in the range of from about 2 to about 11, preferably from about 2 to about 8. Adjustment of pH is normally carried out by including a small quantity of free acid or free base in the formulation. Any acidic material can be used; its selection can be made by anyone skilled in the softener arts on the basis of cost, availability, safety, etc. Any suitable acid can be used to adjust pH. Preferred are hydrochloric, sulfuric, phosphoric and formic acid. Similarly, any suitable base, e.g., sodium hydroxide, can also be used to adjust pH. For the purposes of this invention, pH is measured by a glass electrode in full strength softening composition in comparison with a standard calomel reference electrode.

The compositions of the present invention can be prepared by a number of methods. Some convenient and satisfactory methods are disclosed in the following nonlimiting examples.

All parts, percentages, and ratios herein are by weight unless otherwise specified.

EXAMPLE I

Procedure A

A liquid fabric softener composition containing a micro emulsified amine curable silicone is prepared in the following manner. About 4.33 parts di(hydrogenated tallow)dimethylammonium chloride (DTDMAC), about 1.00 part methyl-1-tallow amidoethyl-2-tallowimidazolinium methylsulfate and about 0.025 parts of a 1% dye solution are weighed into a premix vessel.

After heating to about 75° C. and mixing, the premix is added, with agitation, to a mix vessel (44° C.) containing about 88.14 parts distilled water and about 0.025 parts antioxidant solution. Then about 0.45 parts of perfume is added to this "main" mix. The main mix is then cooled to about 21° C., to which is added, with stirring, about 7.15 parts amine functional silicone microemulsion (about 14% silicone).

Procedure B

Same as Procedure A, except that the amine functional silicone microemulsion is incorporated into the main mix prior to cooling of the mix to 21° C.

TABLE 1

| Ingredient | A and B Approx. Wt. % |
|---|---|
| DTDMAC[1] | 4.33 |
| Methyl-1-tallowamidoethyl-2-tallowimidazolinium methylsulfate | 1.00 |
| Alcohol (from actives) | 0.80 |
| Perfume | 0.45 |
| Dye Solution[4] | 0.025 |
| Micro Emulsified Amine Functional Silicone[2] | 7.15 |
| Antioxidant[3] | 0.025 |
| Distilled Water | 86.12 |

[1]Di(hydrogenated tallow)dimethyl ammonium chloride
[2]A specialty aqueous microemulsion X2-8406 made by Dow Corning Company. It contains about 14% amine functional silicone Dow Corning Q2-8075 and a proprietary emulsification system.
[3]Tenox S-1 supplied by Eastman Kodak.
[4]A 1% solution of Polar Brilliant Blue.

EXAMPLE II

A microemulsified amine functional silicone and fabric softener composition is prepared using Procedure A. The approximate levels of the ingredients are: 2.00 parts Mazamide 6, 0.80 parts MTTMAC, 4.03 parts DTDMAC (defined hereinbefore), 1.00 parts of the imidazolinium salt in Example I, 0.42 parts perfume, 1.28 parts alcohol (from actives), 10.00 parts 14% microemulsified amine functional silicone, and the balance is distilled water. See Table 2 and Example I for a recap of the ingredients and method of preparation.

EXAMPLE III

A microemulsified amine functional silicone and fabric softener composition is prepared using Procedure A. The approximate levels of ingredients are: 17.50 parts Mazamide 6, 6.50 parts DTDMAC, 1.32 parts perfume, 2.07 parts alcohol (from actives), 12.00 parts 14% micro emulsified amine functional silicone, and the balance is distilled water. See Table 2 and Example I for a recap of the ingredients and method of preparation.

TABLE 2

| Ingredient | Example II Approx. Wt. % | Example III Approx. Wt. % |
|---|---|---|
| Mazamide 6[1] | 2.00 | 17.50 |
| MTTMAC[2] | 0.80 | — |
| DTDMAC[3] | 4.03 | 6.53 |
| Perfume | 0.42 | 1.32 |
| Polar Brilliant Blue Dye Solution | 0.025 | 0.072 |
| Alcohol (from actives) | 1.28 | 2.07 |
| Microemulsified Amine Functional Silicone[4] | 10.00 | 12.00 |
| Distilled Water | Balance | Balance |

[1]Reaction product of 2 moles of hydrogenated tallow fatty acid with 1 mole of N-2-hydroxyethylenediamine.
[2]Mono(hydrogenated tallow)trimethyl ammonium chloride (MTTMAC).
[3]Di(hydrogenated tallow)dimethyl ammonium chloride.
[4]Dow Corning X2-8406 (described hereinabove).

EXAMPLE IV

Intrinsic performance of: Q2-7224 (macroemulsion of Q2-8075, 35% silicone) vs. X2-8406 (microemulsion of Q2-8075, 14% silicone). 9.34 grams of Q2-7224 and 23.35 grams of X2-8406 are used as rinse-added fabric softeners to treat poly-cotton (65%/35%) fabrics (concentration of about 50 ppm in the rinse). The fabrics are treated via one wash (no detergent)/rinse/dry treatment. Shear hysteresis measurements are completed on four fabrics of each treatment. The results below show Q2-7224 to be the better softener system for reducing fiber-fiber and yarn-yarn friction.

TABLE 3

| Average Shear Hysteresis (gf/cm) at 2½° and 400 g force | |
|---|---|
| X2-8406 | Q2-7224 |
| 1.53 | 1.35 |

Significant at >95% confidence based on a paired t-test calculation.

EXAMPLE V

Product C

A microemulsified amine functional silicone and fabric softener composition is prepared using Procedure A. The approximate levels of ingredients are: 3.75 parts DTDMAC, 3.40 parts imidazoline, 0.57 parts MTTMAC, 0.40 parts perfume, 0.025 parts dye, 0.77 parts alcohol (from actives), 0.4–0.9 parts HCl, 7.15 parts MAFS (14%) and the balance is distilled water. This composition contains about 1% amine functional silicone fluid.

Comparative Product D

A fabric softener composition is prepared as in Product C, except that about 3.03 parts amine functional silicone macroemulsion (33% silicone) is added. This composition contains about 1% amine functional silicone fluid.

See Table 3, for a recap of ingredients for Products C and D. Both Products C and D contain about 1% Q2-8075 amine functional silicone fluid.

Products C & D are used as rinse-added fabric softeners to treat poly cotton (65%/35%) fabrics. The fabrics are treated via one wash/rinse/dry treatment. The detergents used are TIDE® and LIQUID TIDE®. Six sets (DOWNY®, DOWNY plus X2-8406, and DOWNY plus Q2-7224). of swatches say only TIDE, 6 sets (DOWNY plus X2-8406, and DOWNY plus Q2-7224) of swatches only LIQUID TIDE. Keeping the LIQUID TIDE and TIDE washed fabrics separate, the fabrics were subjected to shear hysteresis measurements. The results below show X2-8406 fabric softener composition to be the better composition for reducing shear hysteresis than the corresponding Q2-8075 composition.

TABLE 4

| Average Shear Hysteresis (gf/cm) at 2½° and 400 g force | | | |
|---|---|---|---|
| | DOWNY ® | DOWNY ® + Q2-7224 | DOWNY ® + X2-8406 |
| TIDE Wash | .69 | .71 | .65 (a) |
| LIQUID TIDE Wash | .88 | .78 | .76 (b) |
| Average | .79 | .74 | .71 (c) |

(a) Significantly lower than DOWNY + Q2-7224 at >95% confidence based on a paired t-test comparison. Significantly lower than DOWNY at >95% confidence based on a paired t-test comparison.
(b) Significantly lower than DOWNY + Q2-7224 at ≧70% confidence. Significantly lower than DOWNY at >95% confidence.
(c) Significantly lower than DOWNY + Q2-7224 at >95% confidence. Significantly lower than DOWNY at >95% confidence.

TABLE 3

| Ingredient | Example V Product C Approx. Wt. % | Example V Product D Approx. Wt. % |
|---|---|---|
| MTTMAC[1] | 0.57 | 0.57 |
| DTDMAC[2] | 3.75 | 3.75 |
| Imidazoline[3] | 3.40 | 3.40 |
| Perfume | 0.40 | 0.40 |
| Polar Brilliant Blue Dye Solution | 0.025 | 0.025 |
| Alcohol (from actives) | 0.77 | 0.77 |
| Microemulsified Amine Functional Silicone[4] (14%) | 7.15 | — |
| Macroemulsified Amine Functional Silicone[5] | — | 3.03 |
| HCl (31.5%) | 0.4–0.9 | 0.4–0.9 |
| Distilled Water | Balance | Balance |

[1]Mono(hydrogenated tallow)trimethyl ammonium chloride
[2]Di(hydrogenated tallow)dimethyl ammonium chloride
[3]1-hydrogenated tallow amidoethyl-2-hydrogenated tallow imidazoline
[4]Dow Corning X2-8406 (described hereinabove)
[5]Dow Corning Q2-7224, a macroemulsion analogue of the microemulsified X2-8406 also containing Dow Corning Q2-8075 silicone fluid.

The incorporation of the microemulsified amine functional silicone delivered via a liquid fabric softener matrix shows improved reduction in shear hysteresis on poly-cotton fabric relative to the traditional macroemulsion delivered via a liquid fabric softener matrix.

What is claimed is:

1. A liquid fabric care composition comprising:

(1) a suitable microemulsified amine functional silicone for improved reduction of fiber-fiber/yarn-yarn friction, wherein said microemulsified amine functional silicone has an average molecular weight of from about 1,000 to about 100,000;

(2) from about 2% to about 35% by weight of the total composition of fabric softener, wherein said fabric softener is selected from the group consisting of:

i. quaternary ammonium compounds;
ii. fatty amines;
iii. fatty amides;
iv. fatty acids;
v. fatty alcohols; and
vi. mixtures thereof; and (3) a suitable carrier for (1) and (2), wherein the weight ratio of microemulsified amine functional silicone to fabric softener is from about 17:1 to about 1:350.

2. The fabric care composition of claim 1 which contains from about 0.05% to about 25% by weight of said microemulsified amine functional silicone.

3. The fabric care composition of claim 2 which contains from about 0.1% to about 15% of said microemulsified amine functional silicone.

4. The fabric care composition of claim 3 which contains from about 0.5% to about 10% of said microemulsified amine functional silicone.

5. The fabric care composition of claim 1 wherein said weight ratio is from about 10:1 to about 1:100.

6. The fabric care composition of claim 5 wherein said weight ratio is from about 1:1 to about 1:10.

7. The fabric care composition of claim 6 wherein said weight ratio is from about 1:5 to about 1:10.

8. The fabric care composition of claim 1 wherein said microemulsified amine functional silicone has an average molecular weight of from about 1,000 to about 100,000 and is made by emulsion polymerization of lower molecular weight silicone polymers, silicone monomers, or mixtures thereof.

9. The fabric care composition of claim 8 wherein said silicone has an average molecular weight of from about 1,000 to about 50,000 and is made by emulsion polymerization of lower molecular weight silicone polymers.

10. The fabric care composition of claim 8 wherein said silicone has an average molecular weight of from about 1,500 to about 20,000.

11. The fabric care composition of claim 1 wherein said fabric softener comprises quaternary ammonium compound.

12. The fabric care composition of claim 11 wherein said fabric softener comprises amine compound.

13. The fabric care composition of claim 12 wherein said fabric softener is a mixture of amide, amine and quaternary ammonium compounds.

14. The fabric care composition of claim 1 wherein:

(a) said microemulsified amine functional silicone is present at a level of from about 0.5% to about 10%;

(b) said fabric softener is present at a level of from about 3% to about 35%, and wherein the ratio of microemulsified amine functional silicone to fabric softener is from about 17:1 to about 1:350.

15. The fabric care composition of claim 14 wherein said fabric softener comprises quaternary ammonium compound.

16. The fabric care composition of claim 15 wherein said fabric softener comprises amine compound.

17. The fabric care composition of claim 16 wherein said fabric softener is a mixture of amide, amine and quaternary ammonium compounds.

18. The liquid fabric care composition of claim 1 wherein said suitable carrier is primarily water and the level of said fabric softener is from about 4% to about 27%.

19. A method of reducing fiber-fiber/yarn-yarn friction in treated fabrics comprising contacting said fabrics with an effective amount of the composition of claim 1 diluted with water.

* * * * *